US005992931A

United States Patent [19]

LaPointe et al.

[11] Patent Number: 5,992,931

[45] Date of Patent: Nov. 30, 1999

[54] MODULAR POWER RECLINING CHAIR

[75] Inventors: Larry P. LaPointe, Temperance; Jonathon R. Saul, Erie; Dennis W. Wright, Monroe, all of Mich.

[73] Assignee: La-Z-Boy Incorporated, Monroe, Mich.

[21] Appl. No.: 09/062,410

[22] Filed: Apr. 17, 1998

Related U.S. Application Data

[63] Continuation-in-part of application No. 08/729,551, Oct. 11, 1996, Pat. No. 5,806,921, which is a continuation-in-part of application No. 08/429,105, Apr. 26, 1995, Pat. No. 5,570,927, which is a continuation-in-part of application No. 08/321,079, Oct. 14, 1994, abandoned, which is a continuation-in-part of application No. 08/230,541, Apr. 20, 1994, Pat. No. 5,427,431, which is a division of application No. 07/897,546, Jun. 18, 1992, Pat. No. 5,323,526, which is a continuation-in-part of application No. 07/819,784, Jan. 13, 1992, Pat. No. 5,222,286, which is a continuation-in-part of application No. 07/772,231, Oct. 11, 1991, Pat. No. 5,301,413.

[51] Int. Cl.[6] ..... A47C 1/02

[52] U.S. Cl. ..... 297/85; 297/330; 297/342

[58] Field of Search ..... 297/440.1, 440.14, 297/330, 85, 342, 341, 68

[56] References Cited

U.S. PATENT DOCUMENTS

| | | | |
|---|---|---|---|
| 3,016,264 | 1/1962 | Hughes . | |
| 3,250,569 | 5/1966 | Gaffney . | |
| 3,479,086 | 11/1969 | Sheridan . | |
| 3,588,170 | 6/1971 | Knabusch et al. . | |
| 3,869,169 | 3/1975 | Johnson et al. . | |
| 3,934,929 | 1/1976 | Rabinowitz . | |
| 4,007,960 | 2/1977 | Gaffney | 297/342 X |
| 4,061,397 | 12/1977 | Lewis . | |
| 4,083,599 | 4/1978 | Gaffney . | |
| 4,127,906 | 12/1978 | Zur . | |
| 4,231,614 | 11/1980 | Shaffer . | |
| 4,364,603 | 12/1982 | Johnson . | |
| 4,365,836 | 12/1982 | Jackson et al. . | |
| 4,386,803 | 6/1983 | Gilderbloom . | |
| 4,696,512 | 9/1987 | Burnett et al. . | |
| 4,786,107 | 11/1988 | Crockett . | |
| 4,946,222 | 8/1990 | Matson . | |
| 4,993,777 | 2/1991 | LaPointe . | |
| 5,061,010 | 10/1991 | LaPointe . | |
| 5,215,351 | 6/1993 | LaPointe . | |
| 5,222,286 | 6/1993 | Saul et al. . | |
| 5,288,126 | 2/1994 | Saul et al. . | |
| 5,301,413 | 4/1994 | Hebegger et al. . | |
| 5,314,238 | 5/1994 | Komorowski et al. . | |
| 5,323,526 | 6/1994 | Saul et al. . | |
| 5,427,431 | 6/1995 | Saul et al. . | |
| 5,435,621 | 7/1995 | Komorowski et al. . | |
| 5,466,046 | 11/1995 | Komorowski et al. . | |
| 5,570,927 | 11/1996 | LaPointe et al. . | |

FOREIGN PATENT DOCUMENTS

| | | | |
|---|---|---|---|
| 594387 | 1/1978 | Switzerland | 297/440.14 |

*Primary Examiner*—Milton Nelson, Jr.
*Attorney, Agent, or Firm*—Harness, Dickey & Pierce, P.L.C.

[57] ABSTRACT

A modular power reclining chair is disclosed which includes a unibody chair frame supported on a power base assembly. A power-assisted linear drive mechanism is operably coupled to an actuation mechanism of the reclining chair to provide power assistance in positioning of a leg rest assembly, a tilt control mechanism and a swing linkage mechanism for moving the reclining chair through its various ranges of motion.

22 Claims, 7 Drawing Sheets

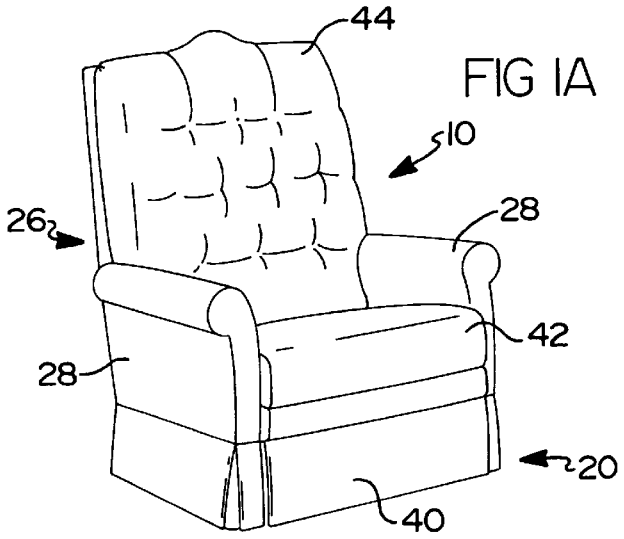
FIG IA
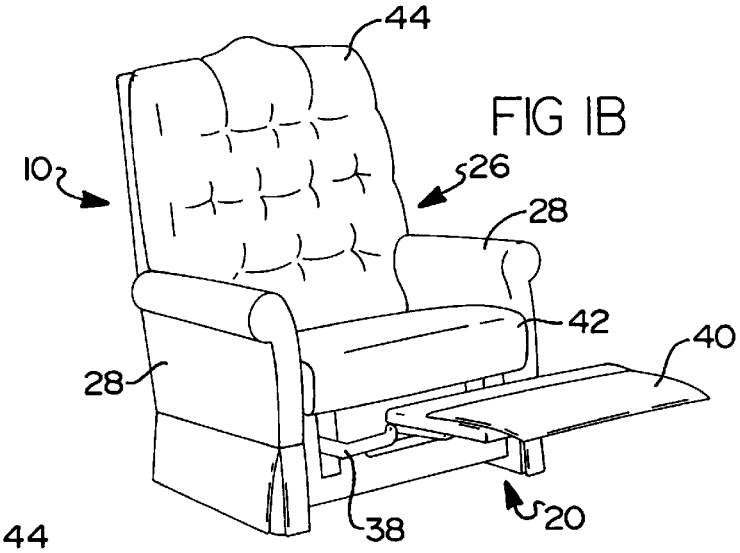
FIG IB
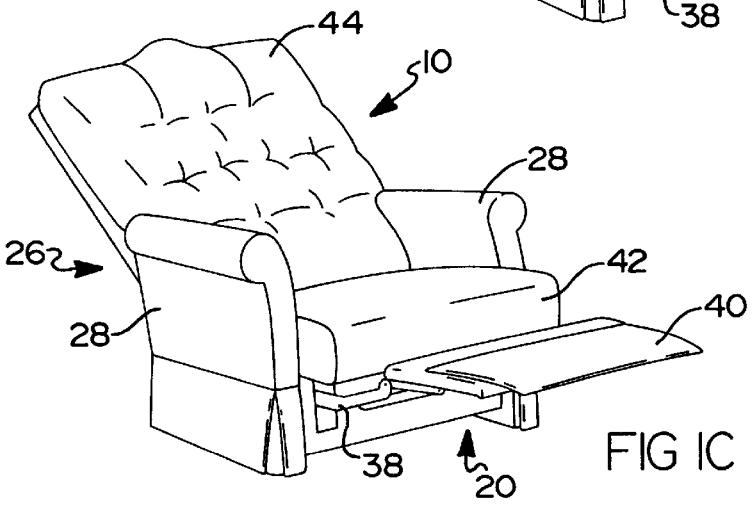
FIG IC

44

12
26
28
30
158
148
146
10
154
156
24
42
16
36
94
20
94
34
38
22
78
62
160
60
18
76
52
56
50
48
58
64
46
54
60
62
56
66
58
118
70
14
116
48

MODULAR POWER RECLINING CHAIR

CROSS-REFERENCE TO RELATED APPLICATIONS

This is a continuation-in-part of U.S. application Ser. No. 08/729,551, filed Oct. 11, 1996 (now U.S. Pat. No. 5,806,921), which is a continuation-in-part of U.S. application Ser. No. 08/429,105, filed Apr. 26, 1995 (now U.S. Pat. No. 5,570,927), which is a continuation-in-part of U.S. application Ser. No. 08/321,079, filed Oct. 14, 1994 (now abandoned), which is a continuation-in-part of U.S. application Ser. No. 08/230,541, filed Apr. 20, 1994 (now U.S. Pat. No. 5,427,431), which is a divisional of U.S. application Ser. No. 07/897,546, filed Jun. 18, 1992 (now U.S. Pat. No. 5,323,526), which is a continuation-in-part of U.S. application Ser. No. 07/819,784, filed Jan. 13, 1992 (now U.S. Pat. No. 5,222,286), which is a continuation-in-part of U.S. application Ser. No. 07/772,231, filed Oct. 11, 1991 (now U.S. Pat. No. 5,301,413).

BACKGROUND OF THE INVENTION

The present invention relates generally to reclining chairs and more particularly to a modular reclining chair having a power-assisted linear drive mechanism operably coupled to an actuation mechanism for positioning a leg rest assembly between extended and retracted positions, for tilting a chair frame relative to the base assembly, and for positioning a seat assembly between upright and reclined positions.

Recent developments in the design and fabrication of various articles of furniture, and in particular reclining chairs, has resulted in the replacement of the "chair within a chair" design by the integrated chair design. The integrated or "knock down" construction of a reclining chair utilizes unique fabrication and assembly techniques which effectively result in increased production efficiency and cost savings while concomitantly producing a high-quality article of furniture. In general, the construction of these integrated reclining chairs is such that a preassembled actuation mechanism is integrated into various frame components which, when assembled, are rigidly interconnected to define a "unibody" chair frame. In this manner, the conventional construction of supporting the actuation mechanism within a separate and distinct frame assembly is no longer required.

The actuation mechanism includes a drive rod and a front support shaft which are supported by and suspended between left and right side frame assemblies. Front and rear frame rail members interconnect the left and right side frame assemblies to define a rigid unibody chair frame which minimizes side-to-side movement of the actuation mechanism suspended therein, as well as lateral flexion of the side assemblies themselves. A major benefit of the "knock-down" assembly can be found in its ability to manufacture a wide variety of reclining-type chairs. The actuation mechanism further includes various mechanisms which relatively position components of the chair to provide certain comfort features. These mechanisms include a pantograph linkage mechanism for positioning a leg rest assembly, a swing linkage mechanism for positioning a seat assembly, and a tilt control mechanism for position the chair frame relative to a base assembly.

There have also been recent developments in power-assisted chairs which include a motor-operated drive mechanism for permitting a seated occupant to actuate the leg rest assembly, to tilt the chair frame relative to the base assembly, and/or to recline the seat assembly between an upright and fully reclined position. However, such chairs generally require the use of multiple motors for driving the separate linkage mechanisms associated with these motion features, thereby resulting in extremely large, heavy and expensive chairs. As such, power reclining chairs have, in the past, typically been targeted for very specific applications, such as to aid those persons needing assistance entering/exiting and operating the chair. Thus, there is a need for a reclining chair which combines the improved structure of a unibody chair frame with a power-assisted reclining mechanism, thereby providing a high-quality, affordable article of furniture.

SUMMARY OF THE INVENTION

In accordance with the principles of the present invention, a reclining chair having an improved unibody chair frame assembly and a power-assisted linear drive mechanism is disclosed which is designed to overcome the disadvantages traditionally associated with fabricating and assembling articles of furniture, and more specifically, a power reclining chair. Therefore, a primary object of the present invention is to provide a reclining chair having a compact power reclining mechanism which can be simply, efficiently and rigidly assembled so as to significantly reduce its overall complexity, weight, and cost, while providing improved operation and comfort.

It is an additional object of the present invention to provide a modular power reclining chair having a leg rest assembly operably positionable by the power-assisted linear drive mechanism between retracted and extended positions.

It is another object of the present invention to provide a modular power reclining chair having a seat assembly suspended within the chair frame and operably coupled to a swing linkage mechanism to permit reclining movement of the seat assembly between upright and reclined positions.

It is a further object of the present invention to provide a rigid base assembly for operably coupling the actuation mechanism and the power-assisted linear drive mechanism to permit selective operation of the leg rest assembly and the swing linkage assembly.

It is still another object of the present invention to provide a modular power reclining chair having a tilt control mechanism operably connected between the base assembly and the chair frame to permit relative angular positioning of the chair frame with respect to the base assembly.

In a preferred embodiment of the present invention, the modular chair frame assembly includes a pair of side assemblies fabricated principally from plywood components which are interconnected at a rear portion by a metal rear frame rail and at a forward portion by a hybrid metal-plywood front frame member assembly. An actuation mechanism including a drive rod and a front support rod is suspended within the chair frame and may be operably coupled to a variety of motion linkage assemblies, such as a swing-link mechanism for operably coupling the seat assembly to the chair frame for reclining the seat back with respect to the seat member, a leg rest assembly for positioning a leg rest, or a tilt control mechanism for tilting the chair frame with respect to the base assembly. The power-assisted linear drive mechanism includes a driven member which is linearly movable in response to rotation of a motor-driven shaft for selectively causing a pair of cams associated with the driven member to sequentially engage a first follower assembly for extending the leg rest assembly and relative tilting movement between the chair frame and the base assembly, and a second follower assembly for causing reclining movement of the chair. The cams associated with the driven member may be arranged in such a manner that the reclining movement does not begin until the leg rest is fully extended. Moreover, such sequential actuation of the leg rest assembly and the reclining linkage assembly are independent and may be easily disabled to selectively eliminate either of the power-assisted features.

Additional objects, advantages and features of the present invention will become apparent from the following description and appended claims, taken in conjunction with the accompanying drawings.

DESCRIPTION OF THE DRAWINGS

FIGS. 1A through 1C illustrate the various operative seating positions for a modular power reclining chair in accordance with a preferred embodiment of the present invention;

DETAILED DESCRIPTION OF THE INVENTION

Figure 2:
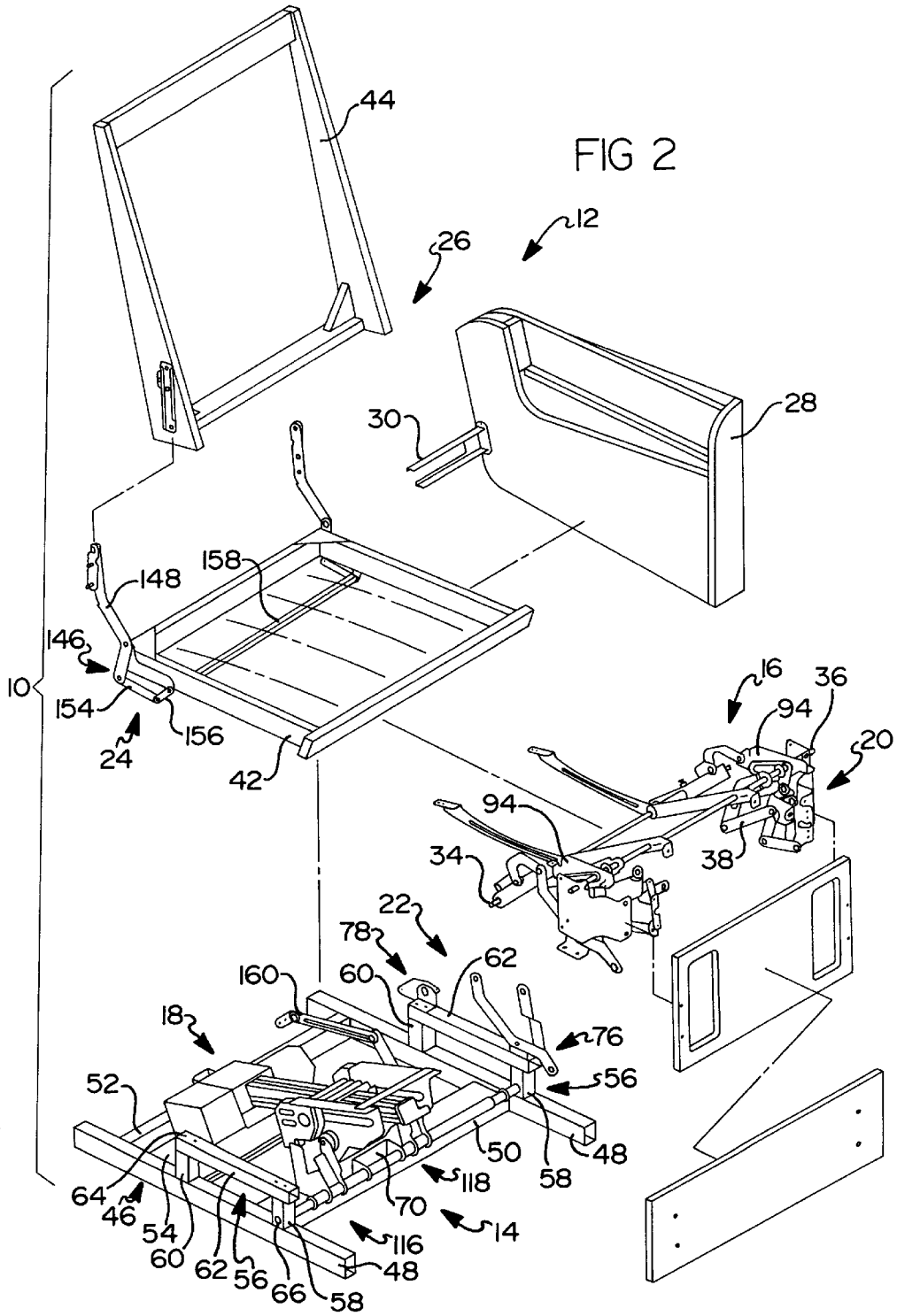
FIG. 2 is an exploded perspective view of a modular power reclining chair in which the upholstery, spring and other components have been removed from the frame components for illustrating their integrated and interdependent association in the present invention.

In accordance with the teaching of the present invention, an modular power reclining chair 10 is disclosed which includes a unibody chair frame 12 supported on power base assembly 14. As such, the present invention is readily adaptable to a "knock down" method of assembly in which an actuation mechanism 16 is a preassembled and "integrated" component of reclining chair 10. More specifically, actuation mechanism 16 is suspended from chair frame 12 so as to provide precise mechanical alignment and superior structural rigidity while employing a highly efficient fabrication and assembly process. A power-assisted linear drive mechanism 18 which is an integral part of power base assembly 14 may be readily interconnected with actuation mechanism 16 to provide power-assisted operation of reclining chair 10.

As presently preferred, reclining chair 10 is capable of a variety of relative motions, namely movement of leg rest assembly 20 between retracted and extended positions, movement of tilt control mechanism 22 to provide relative tilting between chair frame 12 and the power base assembly 14, and movement of swing linkage mechanism 24 to recline seat assembly 26. Moreover, a full range of extension of leg rest assembly 20 is provided prior to significant recline of seat assembly 26. For example, power reclining chair 10 is positionable such that leg rest assembly 20 is in a full retracted position and seat assembly 26 is in a full upright position as shown in FIG. 1A. Initial operation of power-assisted linear drive mechanism 18 causes actuation mechanism 16 to position leg rest assembly 20 into an extended position and tilt control mechanism to tilt chair frame 12 with respect to power base assembly 14 as shown in FIG. 1B. Further operation of the power-assisted linear drive mechanism 18 causes actuation mechanism 16 to position seat assembly 26 into a reclined position as shown in FIG. 1C. Reverse operation of linear drive mechanism 18 results in sequential positioning of seat assembly 26 back to the upright position, tilting of chair frame 12 with respect to base power 14, and leg rest assembly 20 back to the retracted position shown in FIG. 1A.

Referring now to FIG. 2, the various preassembled frame components of chair 10 which can be rapidly and rigidly assembled in a relatively easy and efficient manner are illustrated. As presently preferred, all of the frame components are individually fabricated or subassembled to include the requisite brackets and springs. Subsequently, these preassembled frame components are modularly assembled into unibody chair frame 12 in which actuation mechanism 16 is integrated therein. After chair 10 is completely assembled, the padding and upholstery are applied thereto.

The individual components of chair frame 12 illustrated in FIG. 2 are substantially similar in function and structure to the motion chairs illustrated and disclosed in U.S. Pat. No. 5,222,286 (modular reclining/tilt chair); U.S. Pat. No. 5,570,927 (modular wall proximity reclining chair); U.S. application Ser. No. 08/729,551, filed Oct. 11, 1996 (modular wall proximity reclining chair); and U.S. application Ser. No. 08/872,540, filed Jun. 10, 1997 (glider chair) which are commonly owned by the assignee of the present invention and the disclosure of which are expressly incorporated by reference herein. Accordingly, only those aspects of chair frame 12 which particularly relate to the present invention will be described in detail herein. It should be understood that a more detailed description of the components of the chair frame and its method of assembly not described herein can be found in the above-identified patents and applications which have been incorporated by reference herein.

With reference now to FIG. 2, chair frame 12 includes left and right side frames 28 interconnected at a rear edge by rear cross member 30 and interconnected at a front edge by front cross member 32 to define a rigid "unibody" chair frame. Actuation mechanism 16 is preassembled to include drive rod 34 and front support shaft 36, both of which are spatially oriented to be precisely located and suspended between left and right side frames 28. Actuation mechanism further includes a pair of laterally-spaced rear drive rod supports 150 and a pair of laterally-spaced front drive rod supports 152. Rear drive shaft supports 150 have a forward end journally supported on drive rod 34 and a rearward end secured to a lower flange of rear cross member 30 via a suitable fastener. Similarly, front drive shaft supports 152 have a rearward end journally supported on drive rod 34 extends forwardly to engage front support shaft 36 and is secured to front cross member 32 at a forward end via a suitable fastener. Actuation mechanism 16 is shown to support leg rest assembly 20 thereon. More specifically, leg rest assembly 20 includes left and right pantograph linkages 38 which are operably associated with drive rod 34 and front support shaft 36 for retracting and extending leg rest board 40 in response to rotation of drive rod 34. Seat assembly 26 which includes seat 42 and seat back 44 is located between and supported for reclining movement on side frames 28 by swing link mechanism 24 which includes rear swing linkage 146 and front seat support bracket 94 having lost motion slot 96 formed therein for receiving front support shaft 36.

Figure 3:
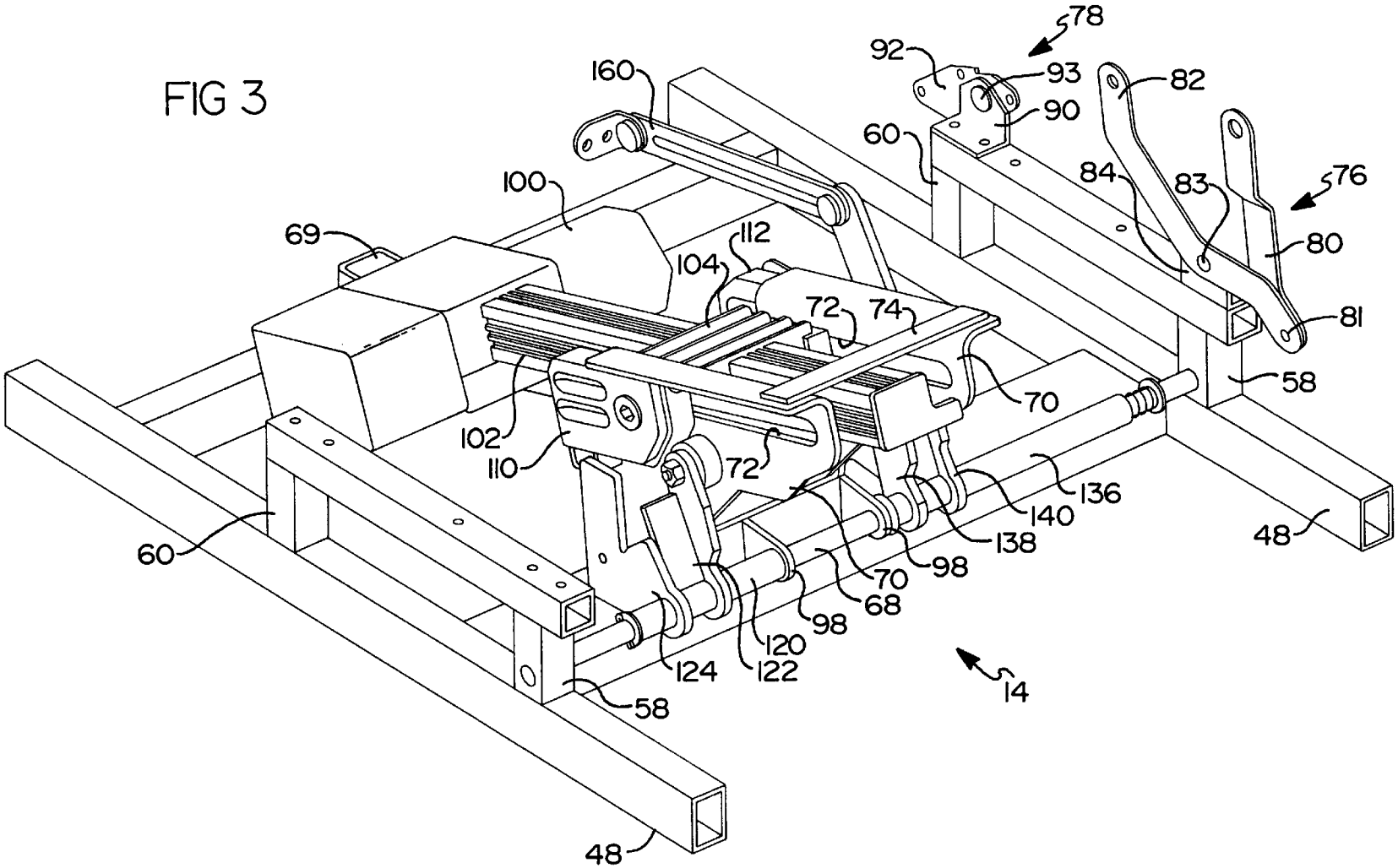
FIG. 3 is a perspective view of the power base subassembly including a linear drive mechanism for the modular power reclining chair of the present invention.

Power base assembly 14 and linear drive mechanism 18 are best illustrated in FIG. 3. Many of the individual components of power base assembly 14 and linear drive mechanism 18 are substantially similar in function and structure to the lift base assembly and linear drive mechanism illustrated and disclosed in U.S. Pat. No. 5,730,494 entitled "Linear Actuation Drive Mechanism For Power-Assisted Chairs" which is commonly owned by the assignee of the present invention and the disclosure of which is expressly incorporated by reference herein. Accordingly, only those aspects of power base assembly 14 and linear drive mechanism 18 which particularly relate to the present invention will be described in detail herein. It should be understood that a more detailed description of the components of power base assembly 14 and linear drive mechanism 18, their interconnection and their operation can be found in the above-identified United States patent which has been incorporated by reference herein.

With reference now to FIG. 3, power base assembly 14 includes stationary frame 46 that rests on the floor and appropriately positions and operably supports linear drive mechanism 18. Stationary frame 46 includes a pair of laterally spaced metal side rails 48 that are rigidly secured to metal front cross rail 50 and metal rear cross rail 52. As presently preferred, rails 48, 50 and 52 of stationary frame 46 are fabricated from standard square steel tubing. Carpet guard 54 is secured to a rear portion of side rails 48 and to rear cross rail 52 directly below a rear portion of linear drive mechanism 18. The leading edge of carpet guard 54 is formed upwardly to facilitate positioning of reclining chair 10 with snagging or "tripping" on the floor. In addition, carpet guard 54 is operably disposed between the motor associated with linear drive mechanism 18 and the floor to further act as a heat shield.

Base standoff 56 extends upwardly from each side rail 48 and provides a location for securing tilt control mechanism 22 to power base assembly 14. More specifically, base standoff 56 includes front upright 58 and rear upright 60 interconnected by transverse cross bar 62. As presently preferred, uprights 58, 60 and cross bar 62 are fabricated from standard square tubing and welded together to form rigid base standoff 56. A plurality of apertures 64 are formed through cross bar 62 in a manner to receive threaded fasteners for securing tilt control mechanism 22 thereto. Similarly, an aperture 66 is formed in front upright 58 and is adapted to receive and generally support torque tube 68 of linear drive mechanism 18. Stationary frame 46 further includes U-shaped pivot bracket 69 secured to a central portion of rear cross rail 52 for pivotally connecting the rear portion of linear drive mechanism 18 to power base assembly 14. Stationary frame 46 also includes a pair of L-shaped drive support brackets 70, each having an elongated slot 72 formed therein. L-shaped drive support brackets 70 are rigidly secured to a top surface of front cross rail 50 and are laterally spaced and located on opposite sides of linear drive mechanism 18. Pivot bracket cross rail 74 is secured across L-shaped drive support brackets 70 for maintaining the lateral spacing therebetween.

Figure 4:
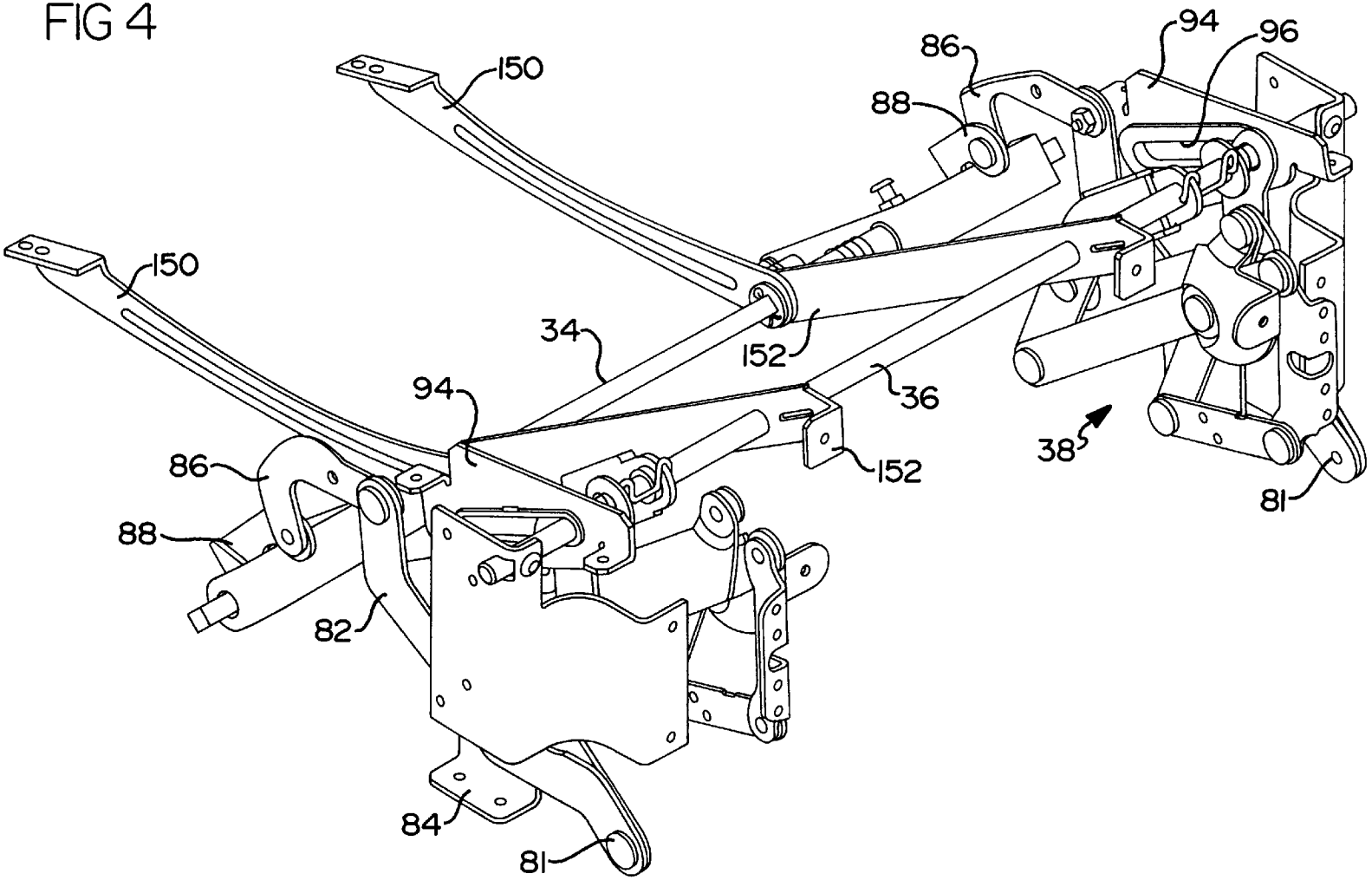
FIG. 4 is a perspective view of the actuation mechanism subassembly including a pantograph linkage and a tilt control mechanism for the modular power reclining chair of the present invention.

Tilt control mechanism 22 includes a pair of front tilt linkages 76 and a pair of rear pivot assemblies 78 (only left side shown) operably coupled between cross bar 62 of stationary frame 46 and side frames 28 for changing the rearward pitch of chair frame 12 with respect to base assembly 14. More particularly, tilt linkage 76 includes lift link 80, the upper end of which is journally supported about support shaft 36. The opposite end of lift link 80 is pivotally connected at pivot 81 to a lower end of lift lever 82. An intermediate portion of lift lever 82 is pivotally secured at pivot 83 to front pivot bracket 84 which is in turn secured to transverse bar 62 with suitable fasteners. The upper end of lift lever 82 is operably connected to drive rod 34 through J-shaped toggle link 86 and drive link 88, as best seen in FIG. 4. Rear pivot assembly 78 includes rear pivot bracket 90 which is secured to cross bar 62 with suitable fasteners and rear pivot mount 92 which is pivotally coupled at pivot 93 to rear pivot bracket 90 and secured to side frames 28 of chair frame 12 with suitable fasteners.

In operation, the interaction between tilt linkage 76 and rear pivot assembly 78 causes rearward tilting of chair frame 12 about pivot 93 relative to base assembly 14 upon rotation of drive rod 34. The geometry of tilt control mechanism 22 is such that lift lever 82 rotates in an upwardly direction which causes lift link 80 to tilt the front of chair frame 12 upwardly and rearwardly approximately 7° about pivot 93. Rotation of lift lever 82 stops when leg rest assembly 20 is fully extended. Since lift link 80 is journally supported on support shaft 36, reclining movement of seat assembly 26 does not result in further tilting of chair frame 12 with respect to base assembly 14.

Figure 5:
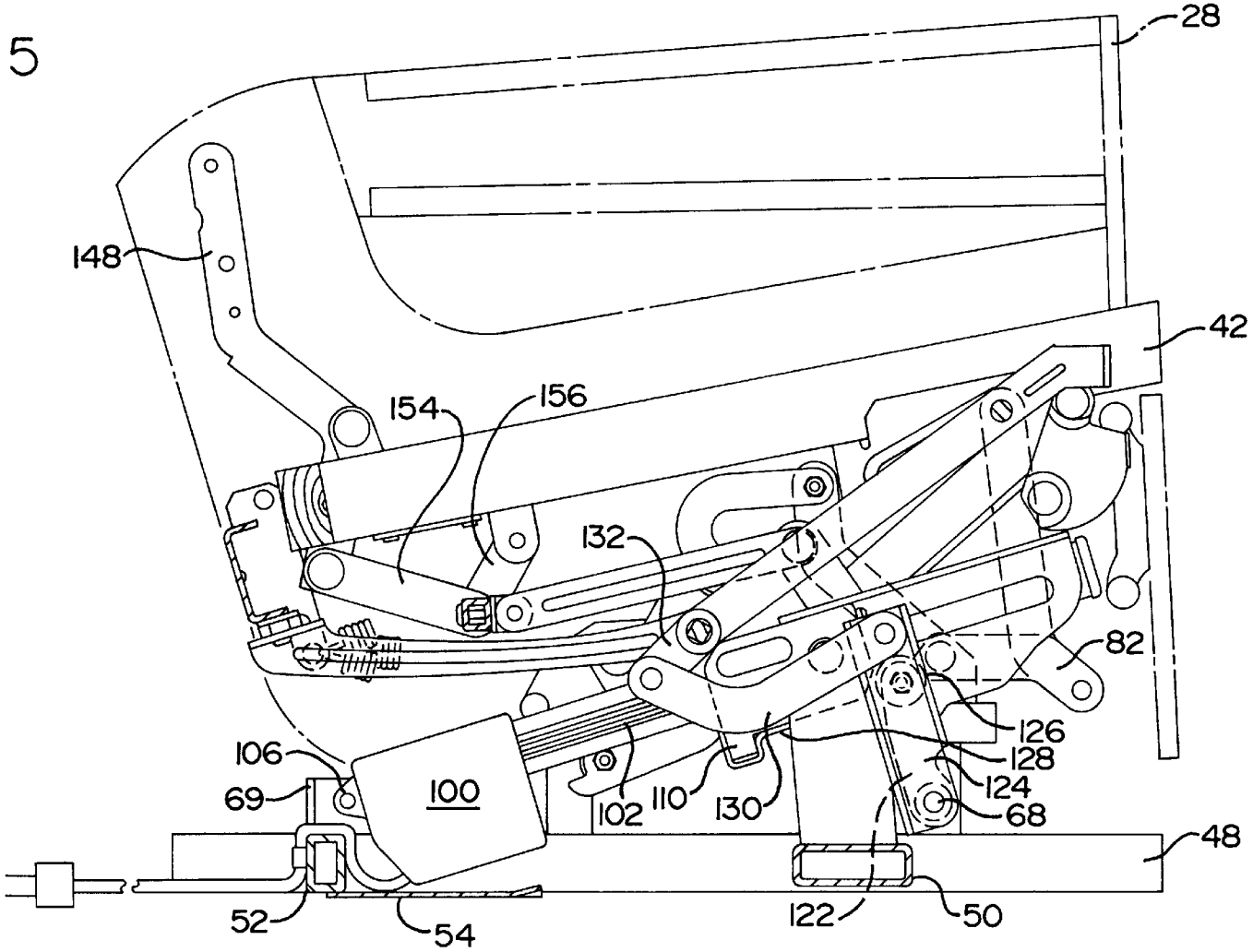
FIG. 5 is a right side view of the modular power reclining chair shown in FIG. 1A illustrating the orientation of the individual components of the chair with the seat assembly in the upright position and the leg rest assembly in the retracted position.
Figure 6:
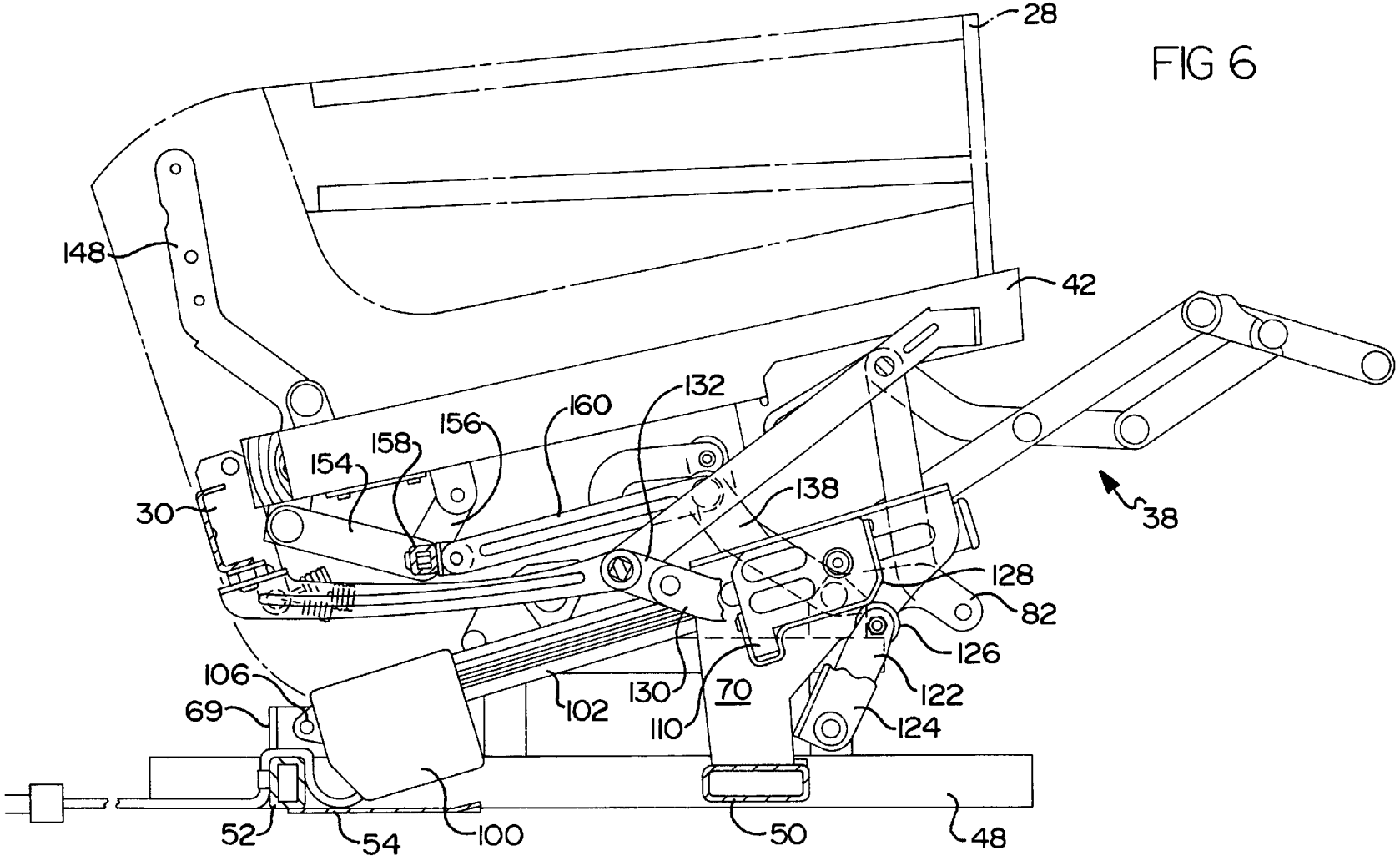
FIG. 6 is a right side view of the modular power reclining chair shown in FIG. 1B illustrating the individual components of the chair with the seat assembly in the upright position, the chair frame tilted with respect to the base assembly, and the leg rest assembly in the extended position.
Figure 7:
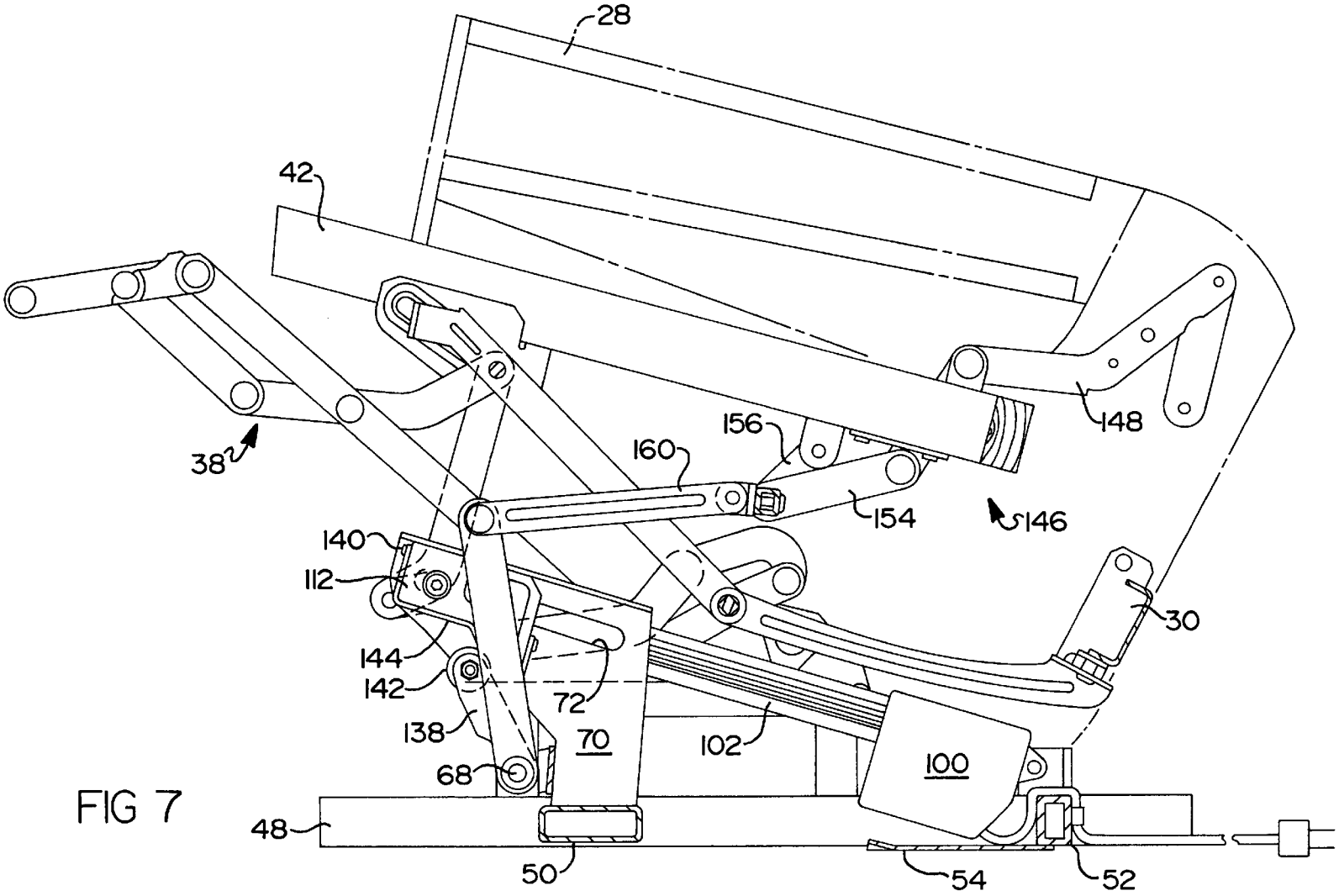
FIG. 7 is a left side view of the modular power reclining chair shown in FIG. 1C showing the individual components of the chair with the seat assembly in the reclined position and the leg rest assembly in the extended position.

As previously described, linear drive mechanism 18 is operably coupled to power base assembly 14 and adapted to drive actuation mechanism 16 for selectively positioning leg rest assembly 20, tilt control mechanism 22 and swing linkage mechanism 24 In response to energization of motor 100. As presently preferred, motor 100 is a DC powered motor which drives a drive shaft (not shown) contained within motor housing 102. The drive shaft is operably coupled to cam guide 104 for linear positioning thereof along motor housing 102. The maximum range of motion of cam guide 104 is controlled by limit switches (not shown) contained within motor housing 102. As best seen in FIGS. 5–7, motor flange 106 extends rearwardly from motor 100 and is received between and pivotally attached to U-shaped pivot bracket 69 of power stationary frame 46. A preferred linear drive mechanism including motor 100, motor housing 102, drive shaft (not shown) and cam guide 104 is available as the OKIDIVE+1 manufactured by Okin of Germany. However, one skilled in the art, will readily appreciate that other suitable linear drive mechanisms may be used to accomplish the same function.

As best seen in FIG. 3, cam guide 104 is operably disposed between L-shaped drive support bracket 70 and supported thereby. More specifically, cam block 110 and cam block 112 are disposed on the outboard side of L-shaped drive support bracket 70. A pair of guide pins 114 associated with each of cam blocks 110, 112 extends through cam blocks 110, 112 and elongated slots 72 formed in L-shaped drive support bracket 70 and is received by cam guide 104. Thus, L-shaped drive support bracket 70 supports the front end of linear drive mechanism 18 while permitting linear movement of cam guide 104 along elongated slot 72. In this manner, cam guide 104 is adapted to move linearly along motor housing 102 such that cam block 110 engages and drives leg rest follower assembly 116 and cam block 112 engages and drives recliner follower assembly 118 which are operably coupled to leg rest assembly 20 and swing link mechanism 24, respectively. As will be appreciated, the use of a single power-assisted drive system, such as linear drive mechanism 18, provides for selectively positioning of leg rest assembly 20 and tilting of chair frame 12 (via leg rest follower assembly 116), as well as positioning of seat assembly 26 (via recliner follower assembly 118).

As previously described, solid shaft 68 extends between front uprights 58 and is further supported by a pair of flanges 98 extending forwardly from L-shaped drive support bracket 70. Solid shaft 68 provides a location for journally supporting leg rest follower assembly 116 and recliner follower assembly 118 to power base assembly 14. More specifically, leg rest follower assembly 116 and recliner follower assembly 118 are concentrically mounted for independent rotational movement on solid shaft 68. Leg rest follower assembly is adapted to rotate drive rod 34 for causing power-assisted actuation of leg rest assembly 20 and power-assisted tilting of chair frame 12. Likewise, recliner follower assembly 118 is adapted to drive swing linkage mechanism 24 causing power-assisted reclining of seat assembly 26.

Leg rest follower assembly 116 includes tubular sleeve 120 concentrically supported on solid shaft 68 and cam lever 122 and cam link 124 secured to sleeve 120. A follower member, such as roller 126, is disposed on an end of cam lever 122 and is adapted to rollingly engage cam surface 128 formed on an underside of leg rest cam block 110. Cam link 124 is operably coupled to drive rod 34 through toggle link 130 and drive link 132. As such, leg rest follower assembly 116 is designed to interact with cam surface 128 of leg rest cam block 110 for selectively actuating pantograph linkages 38 by causing rotation of drive rod 34. More particularly, as cam guide 104 extends forwardly along housing 102 from a first position to a second position, cam surface 128 engages roller 126 and rotates cam link 124 in a clockwise direction (as shown in FIG. 5) about solid shaft 68 to cause a corresponding rotation of drive rod 34 which, in turn, extends pantograph linkage 38.

In a similar construction, recliner follower assembly 118 includes sleeve 136, cam lever 138 and cam link 140. Roller 142 is disposed on an end of cam lever 138 and is adapted to rollingly engage a cam surface 144 formed on an underside surface of recliner cam block 112. An end of cam link 140 is operably coupled to swing linkage mechanism 24 which positions seat assembly 26 through a range of reclined positions.

More specifically, rear swing linkage 146 includes swing link 148 having seat back 44 secured thereto and pivotally interconnecting with seat 42 of seat assembly 26. An upper end of swing link 148 is pivotally coupled to side frames 28 and a lower end of swing link 148 is pivotally coupled to seat 42 via offset link 154 and follower link 156. Tubular cross bar 158 extends laterally between right and left portions of rear swing linkage 146. The end of second cam link 140 is operably coupled to tubular cross bar 158 through connector link 160. As such, recliner follower assembly 118 is designed to interact with cam surface 144 for selectively driving rear swing linkage 146. More particularly, as cam guide 104 extends further forwardly from a second position to a third position, cam surface 144 engages roller 142 and rotates cam link 140 in a counter-clockwise direction (as shown in FIG. 7) about solid shaft 68 to move cross bar 158 forwardly. As will be appreciated, forward movement of cross bar 158 causes corresponding movement of swing linkage mechanism 24 for moving seat assembly 26 to the fully reclined position as shown in FIG. 7. As presently preferred, cam surface 144 is located sufficiently rearward on reclining cam block 112 relative to cam surface 128 formed on leg rest cam block 110 to permit full extension of leg rest assembly 20 prior to initiation of any reclining movement of seat assembly 26. This orientation of cam surface 128 relative to cam surface 144 is best seen by comparison of FIGS. 5–7.

The various components of linear drive mechanism 18 have been described with particular reference to the present invention. As previously noted, additional descriptions of these components can be found in U.S. Pat. No. 5,730,494 which has been incorporated by reference herein. With continued reference to the figures, the operation of modular power reclining chair 10 will now be described. Initially, reclining chair 10 is positioned such that seat assembly 26 is in the full upright position and leg rest assembly 20 is fully retracted. When desired, leg rest assembly 20 can be extended by selectively energizing motor 100 which in turn drives cam guide 104 forwardly from the first, rearward most position to the second, intermediate position along motor housing 102. As such, leg rest cam block 110 is moved forwardly and engages roller 126 which in turn rotates cam link 124, thereby rotating drive rod 34. The rotation of drive rod 34 in a first direction causes pantograph linkage 38 to extend outwardly away from chair frame 12. Continued movement of cam block 110 further rotates drive rod 34 until pantograph 38 achieves its fully extended position. In addition to positioning pantograph 38, rotation of drive rod 34 causes lift lever 82 to urge the front portion of chair frame 12 upwardly so as to rotate about pivot 93. Accordingly, movement of leg rest assembly 20 from the retracted position to the extended position results in concomitant tilting of chair frame 12 with respect to power base assembly 14. When cam guide 104 is in the second, intermediate position, as best seen in FIG. 6, leg rest assembly 20 is fully extended and chair frame 12 is tilted to approximately seven degrees (7°) relative to base assembly 14.

At this point, further forward movement of cam guide 104 from the second position to a third, forward most position causes cam block 112 to drive recliner follower assembly 118. More specifically, cam surface 144 engages roller 142 such that cam link 140 pulls cross bar 156 forwardly, thereby causing seat back 44 to recline and seat 42 to move forwardly with respect to chair frame 12. When cam guide 104 reaches the third position, power reclining chair 10 is positioned such that leg rest assembly 20 is in a fully extended position and seat assembly 26 is in a fully reclined position as best seen in FIG. 7. By reversing the rotation of motor 100, power reclining chair 10 moves through a reverse sequence of the previously described motion until it is returned to the upright position with the leg rest assembly fully retracted.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A modular power reclining chair comprising:

a chair frame including a pair of side frames, a front cross member interconnected to a front portion of said pair of side frames, a rear cross member interconnected to a rear portion of said pair of side frames;

a seat assembly including a seat member and a seat back supported by said chair frame;

an actuation mechanism suspended within said chair frame, said actuation mechanism including a rotatable drive rod;

a leg rest assembly supported from said chair frame and operatively coupled to said drive shaft for movement from a retracted position to an extended position in response to rotation of said drive rod in a first direction; and a base assembly including a stationary frame supporting said chair frame and a linear drive mechanism having a drive motor, a motor housing, a driven member coupled to said drive motor and linearly positionable along said motor housing, a cam extending from said driven member and having a cam surface formed thereon, and a follower rotatably supported from said base assembly and operably coupled to said rotatable drive rod such that said cam surface engages said follower when said driven member is linearly positioned along said motor housing to extend said leg rest assembly.

2. The modular power reclining chair of claim 1 wherein said base assembly further comprises a pair of drive support brackets secured to said stationary frame, each of said pair of drive support brackets having an elongated slot formed therein, said driven member being disposed between said pair of drive support bracket and having a guide pin extending outwardly therefrom and through said elongated slots such that said pair of drive support brackets support said linear drive mechanism.

3. The modular power reclining chair of claim 1 wherein said base assembly further comprises a pair of side rails, a standoff extending from each of said pair of side rails and rigidly secured thereto, and a tilt control mechanism interdisposed between each of said standoffs and said chair frame to permit relative tilting movement between said base assembly and said chair frame.

4. The modular power reclining chair of claim 3 wherein said tilt control mechanism further comprises:

a pivot assembly pivotally coupling said standoff to a rear portion of said chair frame; and a tilt linkage interconnected between said standoff and a front portion of said chair frame, said tilt linkage selectively moveable to urge said front portion of said chair frame in an upwardly direction so as to rotate said chair frame about said pivot assembly, thereby tilting said chair frame with respect to said base assembly.

5. The modular power reclining chair of claim 4 wherein said tilt linkage is operably coupled to said drive rod to provide simultaneous tilting of said chair and extension of said leg rest assembly.

6. The modular power reclining chair of claim 1 wherein said leg rest follower further comprises a shaft secured to said stationary frame, a sleeve disposed over said shaft, a cam link secured to said sleeve at a first end and having a roller disposed on a second end thereof, and a cam lever secured to said sleeve at a first end and operably coupled to said actuation mechanism at a second end thereof.

7. A modular power reclining chair comprising:

a chair frame including a pair of side frames, a front cross member interconnected to a front portion of said pair of side frames, a rear cross member interconnected to a rear portion of said pair of side frames;

a seat assembly having a seat member, a seat back, and a swing link assembly pivotally interconnecting said seat back and said seat member and suspending said seat member within said chair frame to permit reclining movement of said seat assembly between an upright position and a reclined position;

a base assembly including a stationary frame supporting said chair frame and a linear drive mechanism having a drive motor, a motor housing, a driven member linearly positionable along said motor housing, a cam extending from said driven member and having a cam surface formed thereon, and a follower rotatable supported from said base assembly and operably coupled to said swing link mechanism such that said cam surface engages said follower when said driven member is linearly positioned along said motor housing to recline said seat assembly.

8. The modular power reclining chair of claim 7 wherein said base assembly further comprises a pair of drive support brackets secured to said stationary frame, each of said pair of drive support brackets having an elongated slot formed therein, said driven member disposed between said pair of drive support brackets and having a guide pin extending outwardly therefrom through said elongated slot such that said pair of drive support brackets support said linear drive mechanism.

9. The modular power reclining chair of claim 7 wherein said base assembly further comprises a shaft secured to said stationary frame, a sleeve disposed over said shaft, a cam link secured to said sleeve at a first end and having a roller disposed on a second end thereof to define said follower, and a cam lever secured to said second sleeve at a first end and operably coupled to said swing link mechanism at a second end thereof.

10. A modular power reclining chair comprising:

a chair frame including a pair of side frames, a front cross member interconnected to a front portion of said pair of side frames, a rear cross member interconnected to a rear portion of said pair of side frames;

a seat assembly having a seat member, a seat back, and a swing link assembly pivotally interconnecting said seat back and said seat member and suspending said seat member within said chair frame to permit reclining movement of said seat assembly between an upright position and a reclined position;

an actuation mechanism suspended within said chair frame, said actuation mechanism including a rotatable drive rod;

a leg rest assembly supported from said chair frame and operatively coupled to said drive rod for movement from a retracted position to an extended position in response to rotation of said drive shaft in a first direction; and a base assembly including a stationary frame supporting said chair frame and a linear drive mechanism having a drive motor, a motor housing, a driven member linearly positionable along said motor housing, a leg rest follower assembly including a first cam extending from said driven member and having a first cam surface formed thereon and a first follower rotatably supported from said base assembly and operably coupled to said drive rod such that said first cam surface engages said first follower when said driven member is linearly positioned along said motor housing to extend said leg rest assembly, and a recliner follower assembly including a second cam extending from said driven member and having a second cam surface formed thereon and a second follower rotatable supported from said base assembly and operably coupled to said swing link mechanism such that said second cam surface engages said second follower when said driven member is linearly positioned along said motor housing to recline said seat assembly.

11. The modular power reclining chair of claim 10 wherein said base assembly further comprises a pair of side rails, a standoff extending from each of said pair of side rails and rigidly secured thereto, and a tilt control mechanism interdisposed between each of said standoffs and said chair frame to permit relative tilting movement between said base assembly and said chair frame.

12. The modular power reclining chair of claim 11 wherein said tilt control mechanism further comprises:

a pivot assembly pivotally coupling said standoff to a rear portion of said chair frame; and a tilt linkage interconnected between said standoff and a front portion of said chair frame, said tilt linkage selectively moveable to urge said front portion of said chair frame in an upwardly direction so as to rotate said chair frame about said pivot assembly, thereby tilting said chair frame with respect to said base assembly.

13. The modular power reclining chair of claim 12 wherein said tilt linkage is operably connected to said drive rod to provide simultaneous tilting of said chair and extension of said leg rest assembly.

14. The modular power reclining chair of claim 10 wherein said base assembly further comprises a pair of drive support brackets secured to said stationary frame, each of said pair of drive support brackets having an elongated slot formed therein, said driven member being disposed on opposite sides of said pair of support brackets and having a guide pin extending outwardly therefrom through said elongated slot such that said pair of drive support brackets support said linear drive mechanism.

15. The modular power reclining chair of claim 10 wherein said first cam surface engages said first follower to fully extend said leg rest assembly before said second cam surface engages said second follower to recline said seat assembly.

16. The modular power reclining chair of claim 10 further comprising:

a shaft secured to said stationary frame;

said leg rest follower assembly having a first sleeve disposed over said shaft, a first cam link secured to said first sleeve at a first end and having a first roller disposed on a second end thereof to define said first follower, and a first cam lever secured to said first sleeve at a first end and operably coupled to said actuation mechanism at a second end thereof; and said recliner follower assembly having a second sleeve disposed over said shaft, a second cam link secured to said second sleeve at a first end and having a second roller disposed on a second end thereof to define said second follower, and a second cam lever secured to said second sleeve at a first end and operably coupled to said swing link mechanism at a second end thereof.

17. A modular power reclining chair comprising:

a chair frame including a pair of side frames, a front cross member interconnected to a front portion of said pair of side frames, a rear cross member interconnected to a rear portion of said pair of side frames;

a seat assembly having a seat member, a seat back, and a swing link assembly pivotally interconnecting said seat back and said seat member and suspending said seat member within said chair frame to permit reclining movement of said seat assembly between an upright position and a reclined position;

an actuation mechanism suspended within said chair frame, said actuation mechanism including a rotatable drive shaft;

a leg rest assembly supported from said chair frame and operably coupled to said drive shaft for movement from a retracted position to an extended position in response to rotation of said drive shaft in a first direction; and a base assembly including a stationary frame supporting said chair frame and a linear drive mechanism having a drive motor, a motor housing, a driven member linearly positionable along said motor housing, a leg rest follower assembly operably coupled to said actuation mechanism and engageable with said driven member for selectively rotating said drive shaft to extend said leg rest assembly, and a recliner follower assembly operably coupled to said swing link mechanism and engageable with said driven member to selectively recline said seat assembly, said driven member engaging said leg rest follower assembly to fully extend said leg rest assembly prior to said driven member engaging said recliner follower assembly to recline said seat assembly.

18. The modular power reclining chair of claim 17 further comprising:

a shaft secured to said stationary frame;

said leg rest follower assembly having a first sleeve disposed over said shaft, a first cam link secured to said first sleeve at a first end and having a first roller disposed on a second end thereof to define said first follower, and a first cam lever secured to said first sleeve at a first end and operably coupled to said actuation mechanism at a second end thereof; and said recliner follower assembly having a second sleeve disposed over said shaft, a second cam link secured to said second sleeve at a first end and having a second roller disposed on a second end thereof to define said second follower, and a second cam lever secured to said second sleeve at a first end and operably coupled to said swing link mechanism at a second end thereof.

19. The modular power reclining chair of claim 17 wherein said base assembly further comprises a pair of side rails, a standoff extending from each of said pair of side rails and rigidly secured thereto, and a tilt control mechanism interdisposed between each of said standoffs and said chair frame to permit relative tilting movement between said base assembly and said chair frame.

20. The modular power reclining chair of claim 19 wherein said tilt control mechanism further comprises:

a pivot assembly pivotally coupling said standoff to a rear portion of said chair frame; and a tilt linkage interconnected between said standoff and a front portion of said chair frame, said tilt linkage selectively moveable to urge said front portion of said chair frame in an upwardly direction so as to rotate said chair frame about said pivot assembly, thereby tilting said chair frame with respect to said base assembly.

21. The modular power reclining chair of claim 19 wherein said tilt control mechanism is operably to said drive rod to provide simultaneous tilting of said chair and extension of said leg rest assembly.

22. A modular power reclining chair comprising:

a chair frame including a pair of side frames, a front cross member interconnected to a front portion of said pair of side frames, a rear cross member interconnected to a rear portion of said pair of side frames;

a seat assembly having a seat member, a seat back, and a swing link assembly pivotally interconnecting said seat back and said seat member and suspending said seat member within said chair frame to permit reclining movement of said seat assembly between an upright position and a reclined position;

an actuation mechanism suspended within said chair frame, said actuation mechanism including a rotatable drive shaft;

a leg rest assembly supported from said chair frame and operatively coupled to said drive shaft for movement from a retracted position to an extended position in response to rotation of said drive shaft in a first direction; and a base assembly including:

a stationary frame having a pair of side rails, and an standoff extending from each of said pair of side rails, a pair of drive support bracket secured to said stationary frame, each of said pair of drive support bracket having an elongated slot formed therein;

a tilt control mechanism interdisposed between said standoff and said chair frame to permit relative tilting movement therebetween;

a linear drive mechanism having a drive motor, a motor housing and a driven member linearly positionable along said motor housing, said driven member being disposed between said pair of drive support brackets and having a guide pin extending outwardly therefrom through said elongated slot of drive support brackets;

a leg rest follower assembly operably coupling said driven member to said actuation mechanism for selectively rotating said drive shaft to extend said leg rest assembly, said leg rest follower assembly including a first cam extending from said driven member and having a first cam surface formed thereon and a first follower rotatably supported from said base assembly and operably coupled to said drive shaft such that said first cam surface engages said first follower when said driven member is linearly positioned along said motor housing to extend said leg rest assembly; and a recliner follower assembly operably coupling said driven member to said swing link mechanism to selectively recline said seat assembly, said recliner follower assembly comprises a second cam extending from said driven member and having a second cam surface formed thereon and a second follower rotatably supported from said base assembly and operably coupled to said swing link mechanism such that said second cam surface engages said second follower when said driven member is linearly positioned along said motor housing to recline said seat assembly.

* * * * *

UNITED STATES PATENT AND TRADEMARK OFFICE

CERTIFICATE OF CORRECTION

PATENT NO. : 5,992,931

DATED : November 30, 1999

INVENTOR(S) : Larry P. LaPointe, et al.

It is certified that error appears in the above-identified patent and that said Letters Patent is hereby corrected as shown below:

Column 9, line 5, Claim 1; (Examiner's Amendment attached to Notice of Allowability dated 8/11/99, reference to Claim 1, line 10);
"shaft" should be -- rod --.

Column 9, line 26, Claim 2; (Examiner's Amendment attached to Notice of Allowability dated 8/11/99, reference to Claim 2, line 4);
"bracket" should be -- brackets --.

Column 10, line 8, Claim 7; (Application page 3, line 13, Claim 8);
Amendment dated 7/16/99;
"rotatable" should be -- rotatably --.

Column 10, line 49, Claim 10; (Examiner's Amendment attached to Notice of Allowability dated 8/11/99, reference to Claim 12, line 13);
"shaft" should be -- rod --.

Signed and Sealed this

Twentieth Day of February, 2001

*Attest:*

Nicholas P. Godici

NICHOLAS P. GODICI

*Attesting Officer*

*Acting Director of the United States Patent and Trademark Office*